US011585019B2

(12) United States Patent
Ueding et al.

(10) Patent No.: US 11,585,019 B2
(45) Date of Patent: Feb. 21, 2023

(54) METHOD FOR FEEDING A SLIVER END, AND SPINNING MACHINE

(71) Applicant: Maschinenfabrik Rieter AG, Winterthur (CH)

(72) Inventors: Michael Ueding, Ingolstadt (DE); Adalbert Stephan, Beilngries/Paulushofen (DE); Henning Rave, Karlskron (DE)

(73) Assignee: Maschinenfabrik Rieter AG, Winterthur (CH)

( * ) Notice: Subject to any disclaimer, the term of this patent is extended or adjusted under 35 U.S.C. 154(b) by 757 days.

(21) Appl. No.: 16/563,837

(22) Filed: Sep. 7, 2019

(65) Prior Publication Data

US 2020/0080238 A1 Mar. 12, 2020

(30) Foreign Application Priority Data

Sep. 7, 2018 (DE) ..... 10 2018 121 906.7

(51) Int. Cl.
*D01H 5/00* (2006.01)
*D01H 9/00* (2006.01)
*D01H 15/013* (2006.01)

(52) U.S. Cl.
CPC ..... *D01H 5/005* (2013.01); *D01H 9/008* (2013.01); *D01H 15/013* (2013.01)

(58) Field of Classification Search
CPC ..... D01H 5/005; D01H 9/008; D01H 13/005; D01H 15/013
USPC ..... 57/90
See application file for complete search history.

(56) References Cited

U.S. PATENT DOCUMENTS 3,990,221 A * 11/1976 Stahlecker ..... D01H 13/005 57/263
4,150,534 A * 4/1979 Raasch ..... D01H 9/008 57/90
4,866,814 A * 9/1989 Carbonetto ..... D01H 9/008 19/159 A
4,987,645 A * 1/1991 Kawasaki ..... D01H 15/013 19/144

(Continued)

FOREIGN PATENT DOCUMENTS

CN 101407951 A 4/2009
CN 103014945 A 4/2013

(Continued)

OTHER PUBLICATIONS

German Patent Office Search Report, dated Aug. 9, 2019.
EP Search Report, dated Feb. 7, 2020.
Chinese Office Action, dated May 6, 2022.

*Primary Examiner* — Khoa D Huynh
*Assistant Examiner* — Grace Huang
(74) *Attorney, Agent, or Firm* — Dority & Manning, P.A.

(57) ABSTRACT

A spinning machine and method are provided for feeding a sliver end of a sliver deposited in a can to a spinning position of the spinning machine, wherein the spinning machine includes a plurality of adjacently arranged spinning positions and a plurality of cans arranged in at least a first row under the spinning positions. With a sliver gripper of a robot, the method includes seeking the sliver end from one of the cans in an area that includes at least one adjacent spinning position to a spinning position to be supplied. The sliver end is grasped with the sliver gripper and fed to the spinning position to be supplied.

14 Claims, 6 Drawing Sheets

(56) References Cited

U.S. PATENT DOCUMENTS

| | | | | | |
|---|---|---|---|---|---|
| 4,998,406 | A | * | 3/1991 | Raasch | D01H 9/008 57/276 |
| 5,067,204 | A | * | 11/1991 | Shinkai | D01H 9/008 19/159 A |
| 5,263,228 | A | * | 11/1993 | Shinkai | D01H 9/008 19/159 A |
| 5,293,739 | A | * | 3/1994 | Brockmanns | D01H 9/008 57/263 |
| 5,390,484 | A | * | 2/1995 | Schwalm | D01H 9/185 57/90 |
| 5,431,003 | A | * | 7/1995 | Raasch | D01H 9/008 57/90 |
| 5,544,389 | A | * | 8/1996 | Onoue | D01H 9/185 19/157 |
| 5,628,173 | A | * | 5/1997 | Landmesser | B65H 67/0428 57/90 |
| 5,636,411 | A | * | 6/1997 | Greis | D01H 9/008 57/353 |

FOREIGN PATENT DOCUMENTS

| | | | | | |
|---|---|---|---|---|---|
| CN | 103787150 | A | | 5/2014 | |
| DE | 26 46 313 | A1 | | 4/1978 | |
| DE | 42 04 044 | A1 | | 2/1993 | |
| DE | 4204005 | A1 | * | 8/1993 | D01H 13/005 |
| DE | 43 21 367 | A1 | | 6/1994 | |
| DE | 196 54 375 | A1 | | 6/1997 | |
| DE | 10 2005 009 766 | A1 | | 9/2006 | |
| EP | 0 525 447 | A1 | | 2/1993 | |

* cited by examiner

METHOD FOR FEEDING A SLIVER END, AND SPINNING MACHINE

FIELD OF THE INVENTION

The present invention relates to a method for feeding a sliver end of a sliver deposited in a can to a spinning position of a spinning machine. The spinning machine comprises a plurality of adjacently arranged spinning positions including cans located under the spinning positions in at least one row. A robot comprising a sliver gripper grasps the sliver end and feeds it to a spinning position to be supplied. In the case of a spinning machine comprising a plurality of adjacently arranged spinning positions and comprising a robot including a sliver gripper, and comprising cans, containing a sliver, located under the spinning positions in at least one row, a sliver end of a sliver deposited in a can is pieced at a spinning position of the spinning machine to be supplied, wherein, for the purpose of feeding the sliver end, the sliver gripper is equipped with elements for gripping the sliver end and feeding it to the spinning position.

BACKGROUND

DE 10 2005 009 766 A1 describes a maintenance unit for fiber-processing textile machines comprising a plurality of workstations, which includes a handling device for manipulating sliver. The handling device grasps the sliver with the aid of a suction tube and a mechanical and/or pneumatic holding device for the sliver. The suction tube includes a flattened suction tube opening, with the aid of which a sliver end hanging over a can may be drawn in across a relatively wide area. It is disadvantageous in this case that the wide suction tube opening also cannot find the sliver end when the sliver end does not hang over the rim of the can in the area of the workstation to be supplied.

DE 42 04 044 A1 describes a manipulator, which comprises, on its free end, a suction nozzle for taking up and holding the beginning of a sliver. The sliver is held at the can in a clamp, and so the end of the sliver is always to be found at a defined position. The manipulator can therefore grip at this point in a targeted manner and grasp the sliver. It is disadvantageous in this case that each can must be equipped with a clamp and the can must have been placed in a certain direction of rotation at the machine, so that the manipulator can find the sliver end.

DE 43 21 367 A1 describes a device for automatically laying a sliver onto a feed device of a textile machine. The sliver is grasped and is fed to the spinning machine. The grasping of the sliver is facilitated due to the fact that so-called elongate cans are utilized, which are located only under a single spinning position and have a width, which is less than the width of the spinning position itself. As a result, the area in which the sliver end can be located is limited. Elongate cans are more expensive to procure than round cans, however, and require special machines, with the aid of which the sliver can be deposited into the elongate cans.

SUMMARY OF THE INVENTION

A problem addressed by the present invention is therefore that of creating a method and a spinning machine, with the aid of which the described disadvantages are to be avoided. Additional objects and advantages of the invention will be set forth in part in the following description, or may be obvious from the description, or may be learned through practice of the invention.

The problems are solved using a method and a spinning machine having the features described and claimed herein.

The present method according to the invention is utilized for feeding a sliver end of a sliver deposited in a can to a spinning position of a spinning machine. The spinning machine comprises a plurality of adjacently arranged spinning positions including cans located under the spinning positions in at least one row. The cans are preferably round cans. A robot grasps the sliver end with the aid of a sliver gripper and feeds it to a spinning position to be supplied. The sliver end is sought in an area of at least one of the adjacent spinning positions of the spinning position to be supplied, preferably in the area of the spinning position to be supplied and additionally in the area of at least one of the spinning positions adjacent to this spinning position, and is taken up by the sliver gripper. Thereafter, the sliver end is fed to the spinning position to be supplied.

The feeding takes place in that the sliver is inserted into a feed drive of the spinning position equipped with a feed roller. The feed roller can be driven, whereby, once a sliver has been inserted, the spinning operation is restarted and the sliver is continuously drawn into the spinning position.

Due to their large diameter, round cans typically extend along the width of two spinning positions. As a result, when the robot has been positioned with respect to a spinning position, it is possible that the sliver end is to be found either in the area of this spinning position to be supplied or in the area of the adjacent spinning position. With the aid of the method according to the invention, it is now ensured that the sliver end can be reliably grasped, since the sliver gripper seeks the sliver at least in the area of the adjacent spinning position, preferably also additionally in the area of the spinning position to be supplied.

In an advantageous embodiment of the invention, the robot is moved along the spinning machine and is positioned with respect to the spinning position to be supplied or with respect to the spinning position adjacent thereto. The robot can be precisely allocated to this spinning machine with the aid of a running rail laid at this spinning machine. In this case, the robot generally not only feeds the sliver to the spinning position, it also carries out further tasks, which include, for example, piecing a thread, cleaning the spinning position, or exchanging bobbins at the spinning position. Alternatively, the robot can be designed as a can-conveying carriage, which moves along one or multiple spinning machines and not only feeds a sliver to the spinning position, but also exchanges the sliver cans, i.e., replaces the empty sliver can with a full sliver can. It is also possible, of course, that the robot moves along multiple spinning machines similarly to a can-conveying carriage and essentially is responsible only for feeding the sliver to the spinning position.

For the case in which the robot has been positioned with respect to a spinning position adjacent to the spinning position to be supplied, it is preferably provided that the robot is moved, together with the taken-up sliver and before the sliver has been fed into the feed drive of the spinning position, into a position in front of the spinning position to be supplied. As a result, the robot is able to take up the sliver directly at the full can that has been provided for the further spinning. It is particularly easy for the robot to grasp the sliver when the robot has been positioned at the adjacent spinning position in this way, since the robot can execute the same movements for each of the two adjacent spinning positions. As soon as the robot has grasped the sliver, the robot positions itself exactly in front of the spinning position to be supplied and is therefore able to insert the sliver end highly precisely into the feed drive of the spinning position.

Advantageously, the sliver gripper is moved in relation to the robot along the spinning machine to an adjacent spinning position and/or to a can located in a second row. Therefore, even when a robot is at a standstill, the sliver gripper is able to seek the sliver in a predefined area, which can be larger than the actual area that the sliver gripper itself can reach. In this case, it is possible, although not absolutely necessary, that the robot is immediately positioned at the spinning position to be supplied and, with the aid of an appropriate movement of the sliver gripper, seeks and grasps the sliver in the area of the adjacent spinning position or in the second row of the positioned cans and inserts the sliver into the feed drive of the spinning position.

Preferably, it is provided that the sliver gripper can take up the sliver simultaneously from multiple possible positions at adjacent spinning positions. Therefore, it is possible that the sliver gripper seeks the sliver at the spinning position to be supplied as well as at adjacent spinning positions arranged to the left or the right of this spinning position and, there, grasps the sliver.

In an advantageous embodiment of the invention, it is provided that the sliver gripper seeks the sliver on the top side of the can and/or on the circumference of the can. When the sliver gripper seeks the sliver on the top side of the can, it is further advantageous when the sliver end is deposited in a chord-like manner on the top side of the can. Therefore, a defined area is specified, in which the sliver gripper can find the sliver end. When the sliver is located on the circumference of the can, it is possible that the sliver is fixed on the can in a defined position or hangs out of the can at least at this position. It is therefore also easily possible for the sliver gripper to quickly find and grasp the sliver end.

A spinning machine according to the invention comprises a plurality of adjacently arranged spinning positions and a robot, on which a sliver gripper is arranged. Cans comprising a sliver and positioned in at least one row are located under the spinning positions. In order to feed a sliver end of a sliver deposited in a can to a spinning position of the spinning machine to be supplied, the sliver gripper is equipped in such a way that it can grasp the sliver end and feed it to the spinning position. For this purpose, the sliver gripper is designed and/or arranged on the robot in such a way that it can take up the sliver end in an area of at least one spinning position, which is adjacent to the spinning position to be supplied, preferably in the area of the spinning position to be supplied and additionally at at least one of the spinning positions adjacent to this spinning position, and then feed the sliver end to the spinning position to be supplied. The sliver gripper is therefore able to reliably find the sliver end and feed the sliver end, in a targeted manner, to the spinning position at which the sliver is lacking, so that the spinning process can be continued at this spinning position.

The invention is directed to the consideration that, in the case of round sliver cans having a diameter approximately corresponding to the width of two spinning positions, the sliver is located either in the area of the spinning position to be supplied or in the area of the adjacent spinning position and is more likely to be found there. It is particularly advantageous when the robot is designed in such a way that it finds the sliver end at only one single spinning position. The likelihood of finding the sliver is therefore greater. As a result, it can also be necessary, however, to position the robot at the adjacent spinning position in order to be able to find the sliver end. As soon as the sliver end has been grasped by the sliver gripper, the robot can be moved, together with the sliver end, into the correct position in front of the spinning position to be supplied and, there, can feed the sliver end to the feed drive of the spinning position. If the sliver end is located in front of the spinning position to be supplied and not at the adjacent spinning position, however, it can also be advantageous when the robot is already positioned correctly and directly in front of the spinning position to be supplied and the sliver gripper seeks and grasps the sliver end there. Provided the sliver end is located between the two spinning positions, it can be advantageous, depending on the design of the sliver gripper, that the robot is positioned either at the adjacent spinning position or at the spinning position to be supplied in order to find the sliver end.

If the robot is advantageously arranged stationarily at the spinning position and/or at a can changer, and/or at the spinning machine so as to be movable along the spinning machine, an approach for feeding the sliver end can be individually provided depending on the necessary productivity of the machine. In the case that the robot is stationarily arranged at the spinning position, it is necessary that each of the plurality of spinning positions at the spinning machine comprises a robot, which can insert the sliver into the feed drive. It is advantageous in this case that a mobile robot does not first need to be requested and, therefore, no waiting time is necessary before the sliver can be pieced. If the robot is situated at a can changer, the feeding of the sliver or at least a preparation for the feeding of the sliver to the feed drive of the spinning position can be carried out together with the exchange of an empty can for a new, full can. The individual spinning position can grasp this presented sliver, if necessary, or draw it into the feed drive and continue the spinning process. In a further alternative, the robot at the spinning machine is movable along this spinning machine. This means, the robot is guided, for example, on a rail of the spinning machine and patrols along the spinning machine. After a can change has been carried out, the robot moves along the spinning machine up to the spinning position to be supplied and carries out the feeding of the sliver. In this case, it is particularly advantageous that the precise positioning of the robot in front of the spinning position can also be utilized for further maintenance actions at the spinning position, for example, feeding a thread or cleaning the spinning position.

In a very particularly advantageous embodiment of the invention, the robot is movable along multiple spinning machines. The robot can therefore switch from one spinning machine to another spinning machine. Waiting times of the robot until a further maintenance requirement or sliver change must be carried out can be kept short as a result.

It is advantageous when the sliver gripper is designed to be movable in relation to the robot along the spinning machine to an adjacent spinning position and/or to a can located in a second row. In the event that a robot is at a standstill in front of or next to the spinning position to be supplied, it is therefore possible for the sliver gripper to seek and grasp the sliver end in a larger area than the sliver gripper would permit per se. The situation is therefore avoided, in which the robot must be repositioned after the sliver end has been found, in order to feed the sliver end to the spinning position to be supplied.

In an advantageous embodiment of the sliver gripper, the sliver gripper is able to simultaneously take up the sliver from multiple possible positions at adjacent spinning positions.

A particularly advantageous embodiment of the sliver gripper consists, for example, of a very wide sliver gripper, which accesses the area of the spinning position to be supplied as well as the adjacent spinning position and simultaneously seeks the sliver end. It is advantageous in this case when the sliver gripper has a width in order to be able to grasp the sliver end at at least two adjacent spinning positions.

In an advantageous embodiment of the invention, if the sliver gripper comprises a suction unit, which is suitable for drawing in the sliver end, the sliver gripper can simultaneously seek the sliver end in a larger area than is the case with a mechanical gripper.

In a particularly advantageous embodiment of the invention, the sliver gripper comprises a blowing unit for feeding the sliver end into the feed drive of the spinning position. The insertion of the sliver end into the feed drive of the spinning position can therefore be very easily and reliably carried out.

BRIEF DESCRIPTION OF THE DRAWINGS

Further advantages of the invention are described in the following exemplary embodiments. Wherein.

DETAILED DESCRIPTION

Figure 1:
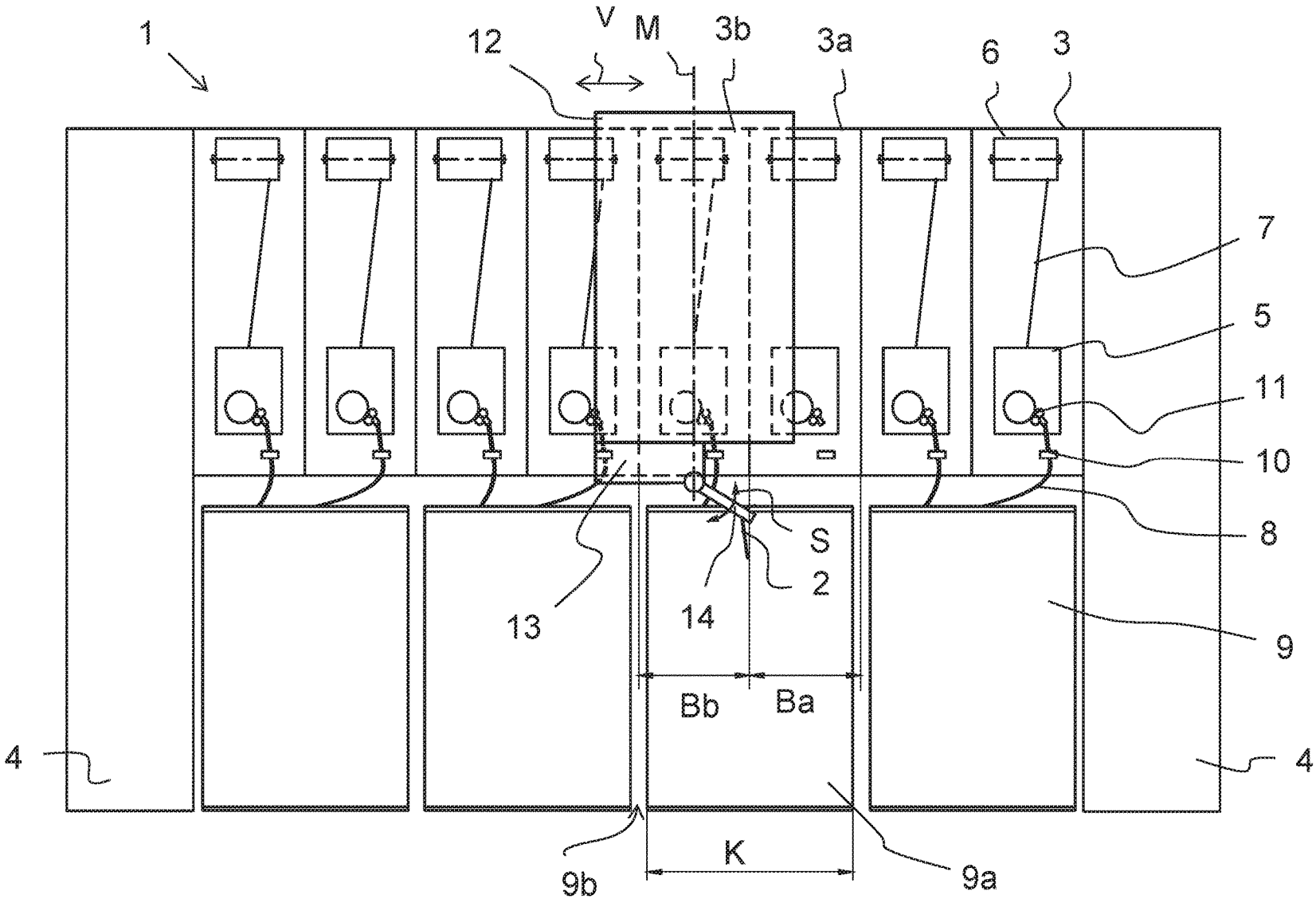
FIG. 1 shows a side view of a spinning machine before a sliver end has been grasped.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the alternative exemplary embodiments represented in the figures, the same reference signs are utilized for features that are identical or at least comparable in terms of their configuration and/or mode of operation. Provided the features are not described in detail again, their design and/or mode of operation correspond/corresponds to the design and mode of operation of the above-described features.

FIG. 1 shows a side view of a spinning machine 1 before a sliver end 2 has been grasped. The spinning machine 1 comprises a plurality of spinning positions 3, which are arranged next to one another. A machine frame 4 is located at each of the two ends of the spinning machine 1. Each spinning position 3 comprises a spin box 5 as well as a bobbin 6, onto which a yarn 7 is wound. The yarn 7 is spun in the spin box 5 from a sliver 8, which is fed to the spin box 5 from a can 9. The sliver 8 is actively fed to the spin box 5 with the aid of a feed drive 11, which consists of at least one driven roller. On the path between the can 9 and the spin box 5, the sliver 8 is guided through a loop-catching means 10, which is intended to prevent the formation of loops, which could result in a sliver break, in the sliver 8 during the withdrawal of the sliver 8 from the can 9.

When the sliver 8 contained in the can 9 has been used up, the can 9 is exchanged for a full can 9. The sliver end 2 of the sliver 8 contained therein hangs, for example, over the upper rim of the can 9*a*, as represented by the can 9*a*. The sliver 8 is lacking at the spinning position 3*a* to be supplied, at which the sliver 8 is to be pieced in order for the spinning operation to be continued. The adjacent spinning position 3*b* continues to receive its sliver 8 from a can 9*b*, which is arranged, not visibly, behind the can 9*a* in a second row. The sliver end 2, which hangs over the rim of the can 9*a*, can be located either in an area Ba below the spinning position 3*a* to be supplied or in the area Bb below the adjacent spinning position 3*b*.

A robot 12 is located in front of the adjacent spinning position 3*b*, as indicated with the aid of a center line M. The robot 12 can be moved along the spinning machine 1 as indicated by the double arrow V. When a spinning position 3 reports to a control unit that service is required, for example, a sliver 8 is lacking at a certain spinning position 3, the robot 12 is stopped at this spinning position 3, specifically in this case the spinning position 3*a* to be supplied or the adjacent spinning position 3*b*, and begins its maintenance work. In the representation of FIG. 1, the robot 12 is therefore located in front of the adjacent spinning position 3*b*.

A sliver piecing unit 13, on which a sliver gripper 14 is located, is arranged on the robot 12. In the exemplary embodiment represented here, the sliver gripper 14 is a suction tube, which is capable of drawing in the sliver end 2. The sliver gripper 14 can be swiveled according to the double arrow S, so that it can move the drawn-in sliver end 2 in the direction of the feed drive 11 for feeding the sliver end 2 at the spinning position 3*a*.

The sliver gripper 14 can also be designed in a way other than a pneumatically operated suction tube, of course. For example, a mechanical gripper is also possible, which grasps the sliver end 2 at the can 9*a*.

According to the exemplary embodiment of FIG. 1, the robot 12 is located in front of the adjacent spinning position 3*b*. The sliver gripper 14 can find and grasp the sliver end 2, which can be located in the area Ba or Bb, for example, with the aid of the swivel movement S. Due to the fact that the robot 12 is positioned at the adjacent spinning position 3*b*, the sliver gripper 14 can grasp the sliver end 2, in particular, in its area Bb. The sliver gripper 14 is also able to grasp this sliver end 2 when the sliver end 2 is located in the area Ba of the spinning position 3*a* to be supplied.

Figure 2:
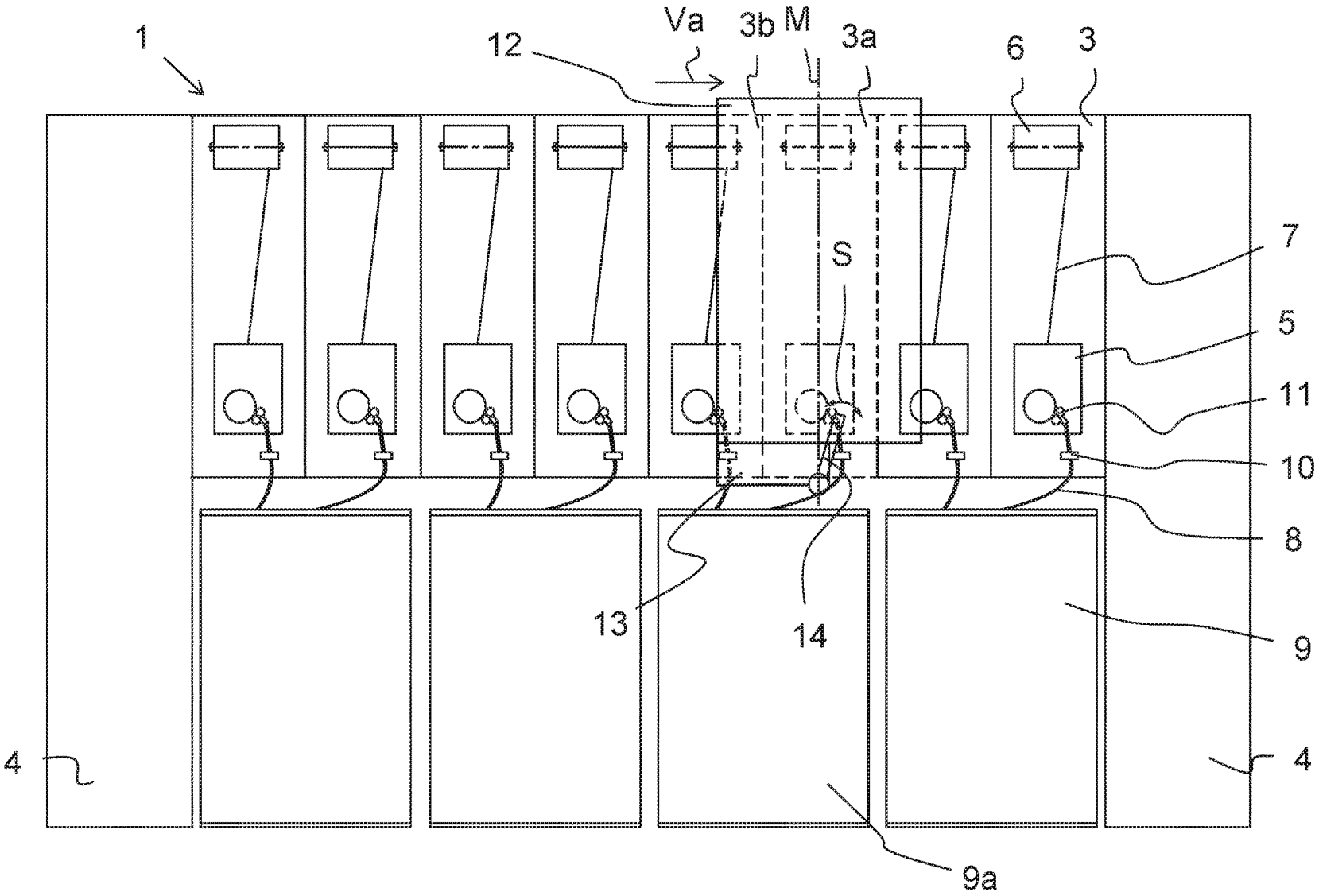
FIG. 2 shows the spinning machine from FIG. 1 during the feeding of a sliver end at a spinning position.

FIG. 2 shows the spinning machine from FIG. 1 during the feeding of the sliver end 2 at the spinning position 3*a*. The robot 12 is moved, according to the arrow Va, in the direction of the spinning position 3*a* to be supplied and is positioned there. The sliver gripper 14 has grasped the sliver end 2 during this movement and guides the sliver end 2 to the spinning position 3*a* to be supplied. Due to a swivel movement S of the sliver gripper 14 in the direction toward the feed drive 11 of the spinning position 3*a* to be supplied, the sliver 8 or the sliver end 2 is moved toward the feed drive 11 of the spinning position 3*a* to be supplied and, there, can be inserted into the feed drive 11, for example, with the aid of pressure pulse from the sliver gripper 14. For the purpose of inserting the sliver 8 into the loop-catching means 10, either the sliver gripper 14 can comprise units, which thread the sliver 8 through the loop-catching means 10, or the loop-catching means 10 is designed in such a way that it can perform its function, for example, by the sliver 8 having been inserted sideways into the loop-catching means 10.

When the sliver end 2 has been inserted into the feed drive 11 and the spinning process is ready for spinning yarn 7 once more or is underway again, the robot 12 leaves the spinning position 3*a* to be supplied and carries out further maintenance work at other spinning positions 3.

As is apparent from the exemplary embodiment of FIGS. 1 and 2, the robot 12 is therefore positioned, first of all, in the area of the adjacent spinning position 3*b*, seeks the sliver end 2 at least in the area Bb of the adjacent spinning position 3*b* but also, in this case, in the area Ba of the spinning position 3*a* to be supplied, and takes up the sliver end 2. Thereafter, the robot 12 moves in front of the spinning position 3*a* to be supplied, positions itself there, and inserts the sliver end 2 into the feed drive 11 of the spinning position 3*a* to be supplied.

Alternatively, it could also be possible that the sliver gripper 14 is designed in such a way that it seeks and grasps the sliver end 2 in the area Bb of the adjacent spinning position 3*b* on the one hand, but, thereafter, inserts the sliver end 2 into the feed drive 11 of the spinning position 3*a* to be supplied without a further movement of the robot 12, for example, with the aid of an articulated or telescopic movement of the sliver gripper 14.

Figure 3:
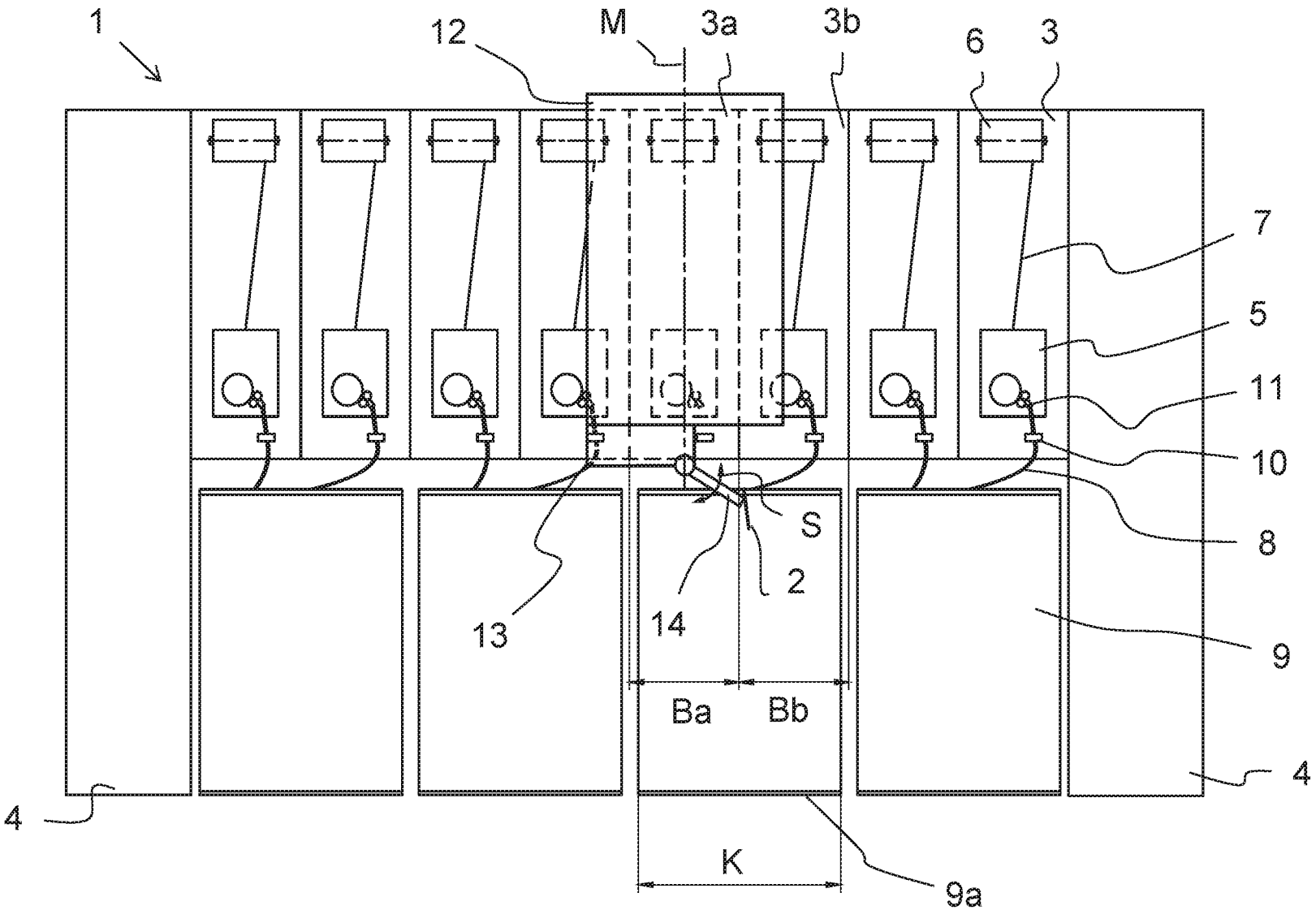
FIG. 3 shows the spinning machine from FIG. 1 before a sliver end has been grasped in order to be fed at another spinning position.
Figure 4:
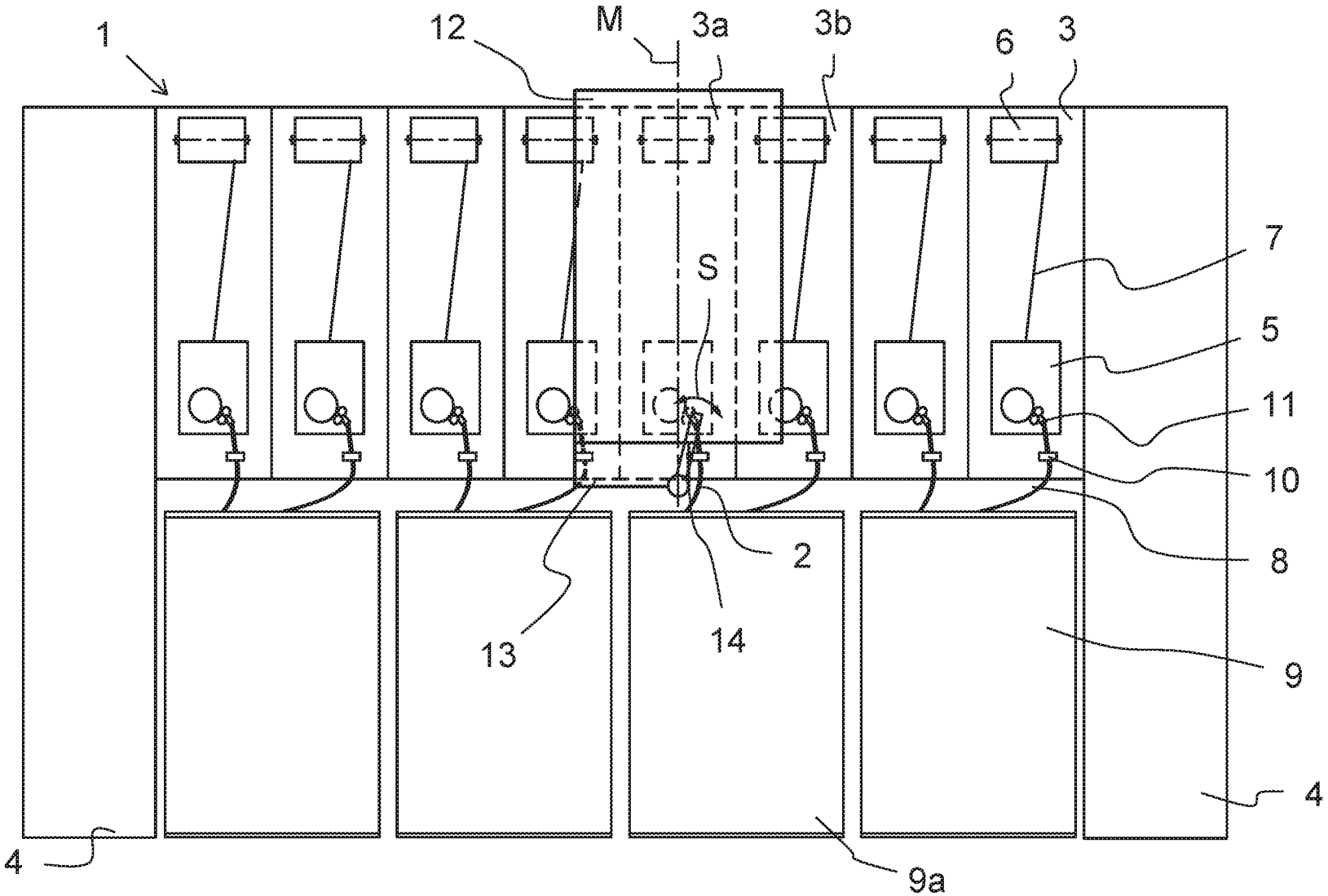
FIG. 4 shows the spinning machine from FIG. 1 during the feeding of a sliver end at the other spinning position.

FIG. 3 shows the spinning machine 1 before a sliver end 2 has been grasped in order to be fed at another spinning position 3, which is therefore referred to in this case as the spinning position 3*a* to be supplied. In this exemplary embodiment, the robot 12 is positioned in front of the spinning position 3*a* to be supplied. The sliver gripper 14 is able, with the aid of a swivel movement S, to grasp the sliver end 2, which is hanging out of the can 9*a* and is located in the area Bb of the adjacent spinning position 3*b*. As soon as the sliver end 2 has been grasped by the sliver gripper 14, the sliver gripper 14 swivels, as represented in FIG. 4, upward in the direction toward the feed drive 11 and inserts the sliver end 2 into the feed drive 11 either autonomously or with the aid of further insertion elements. As this exemplary embodiment of FIGS. 3 and 4 shows, it is not necessary in this case, after the sliver end 2 has been found, for the robot 12 to be repositioned in order to feed the sliver end 2 into the feed drive 11 of the spinning position 3*a*.

The different piecing methods with and without a movement of the robot 12 according to FIG. 1 and FIG. 2, and FIG. 3 and FIG. 4, respectively, result, inter alia, from the fact that the cans 9 have a width or a diameter K, which corresponds to approximately twice the width of a spinning position 3. This means, the spinning position 3*a* to be supplied can be arranged either on the left side or on the right side of the can 9, which is located under the two spinning positions 3*a* and 3*b*. It can therefore be advantageous in different ways that the robot 12 is moved toward the spinning position 3*a* to be supplied after the sliver end 2 has been found, as represented in FIG. 1 and FIG. 2, on the one hand, or a displacement of the robot 12 is not necessary, as represented in FIGS. 3 and 4, in which the spinning position 3*a* to be supplied is arranged on the left side of the can 9.

Figure 5:
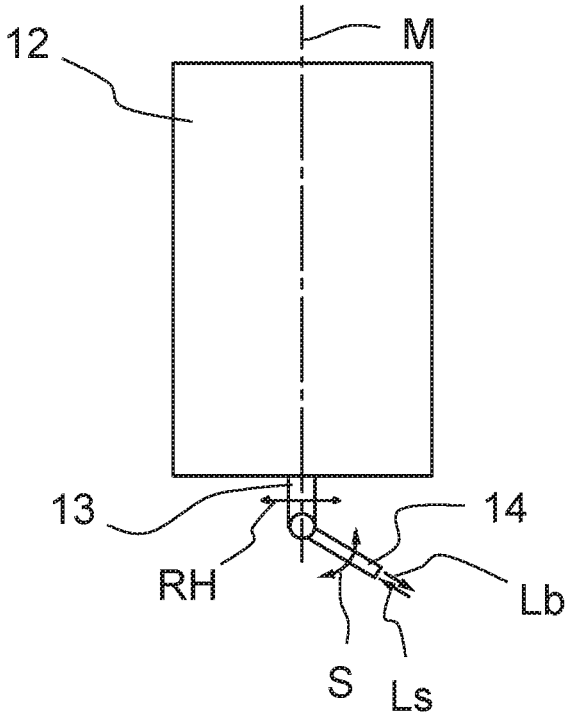
FIG. 5 shows an exemplary embodiment of a robot comprising a sliver gripper, which is movable in relation to the robot.

FIG. 5 shows an exemplary embodiment of a robot 12 comprising a sliver gripper 14, which is movable in relation to the robot 12. In this exemplary embodiment, the sliver gripper 14 is moved together with the sliver piecing unit 13 in the horizontal direction RH in relation to the robot 12. It is therefore very easily possible, together with a swivel movement S of the sliver gripper 14, if necessary, that the sliver end 2 is sought and found in the area Bb of the adjacent spinning position 3*b* and, if necessary, additionally in the area Ba of the spinning position 3*a* to be supplied.

As further indicated in the exemplary embodiment of FIG. 5, the sliver gripper 14 is pneumatically operated. According to the arrow Ls, the sliver gripper 14 is able to draw the sliver end 2 into the sliver gripper 14. In order to feed the sliver 8 or the sliver end 2 into the feed drive 11 of the spinning position 3*a*, the suction flow can be switched to a stream of compressed air and, therefore, blow the sliver end 2 into the feed drive 11 according to the arrow Lb. As a result, the feeding of the sliver end 2 or the sliver 8 at the spinning position 3*a* to be supplied can take place in a highly reliable manner.

Figure 6:
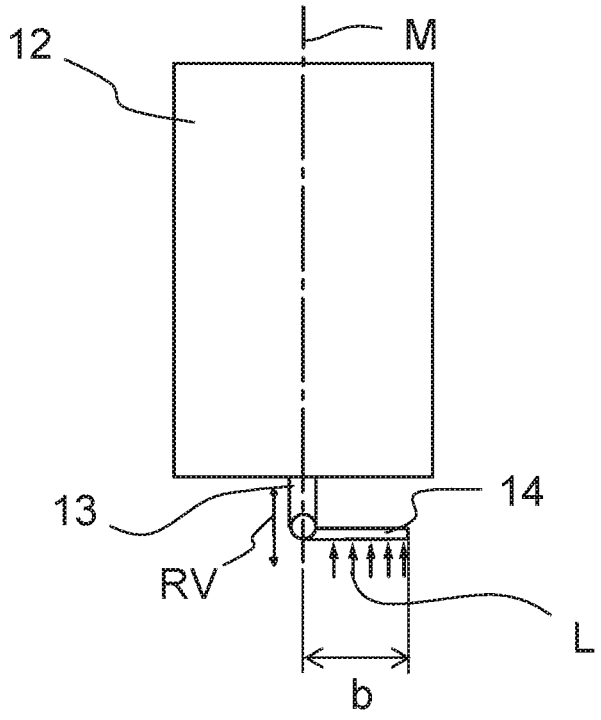
FIG. 6 shows an exemplary embodiment of a robot comprising a wide sliver gripper.

A further exemplary embodiment of the invention is represented in FIG. 6. FIG. 6 shows an exemplary embodiment of a robot 12 comprising a wide sliver gripper 14. The sliver gripper 14 has a width b, due to which it is able to grasp a sliver end 2 in the area Ba as well as in the area Bb. In contrast to the embodiment according to FIG. 5, the air flows L are not provided at the end of the sliver gripper 14, but rather along the sliver gripper 14 and draw in the sliver 8 transversely to the sliver gripper 14. In order to be able to reliably grasp the sliver end 2, it can be advantageous that the sliver piecing unit 13 is movable, together with the sliver gripper 14, vertically in relation to the robot 12, according to the double arrow RV. In this case, it can be sufficient that the sliver gripper 14 is stationarily, i.e., not swivelably, arranged on the sliver piecing unit 13.

Figure 7:
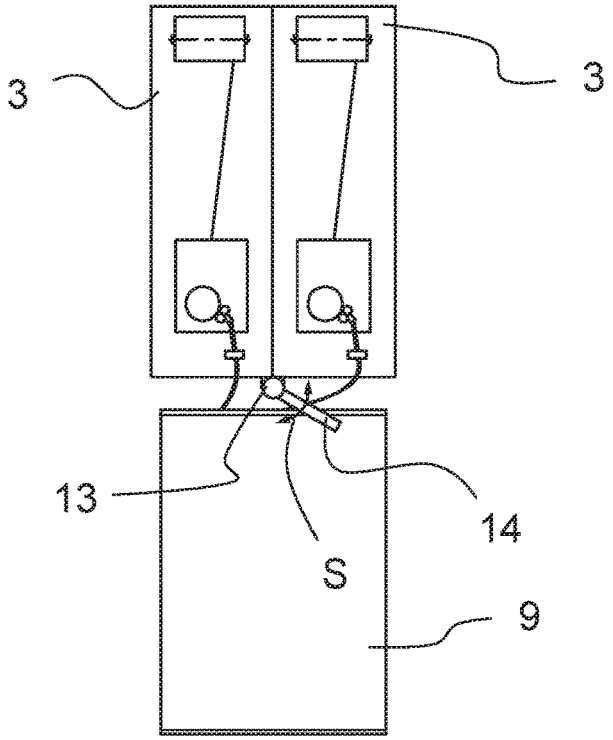
FIG. 7 shows two spinning positions comprising a stationarily arranged sliver gripper.

FIG. 7 shows two spinning positions 3 comprising a stationarily arranged sliver gripper 14. The sliver gripper 14 or the sliver piecing unit 13 is fixedly attached with respect to the two spinning positions 3. Due to a swivel movement of the sliver gripper 14 according to the double arrow S, the sliver gripper 14 is able to grasp a sliver end 2 in the area Ba as well as in the area Bb (according to FIG. 1 resp. FIG. 3) and feed it to the spinning position 3*a* to be supplied. Depending on which spinning position 3 the sliver 8 is lacking, the sliver gripper 14 can feed the sliver end 2 either to the spinning position 3 arranged on the left side of the can 9 or to the spinning position 3 arranged on the right side of the can 9.

The sliver piecing unit 13 can also be designed to be vertically as well as horizontally displaceable, of course, according to the double arrow RV and, additionally, according to the double arrow RH.

Figure 8:
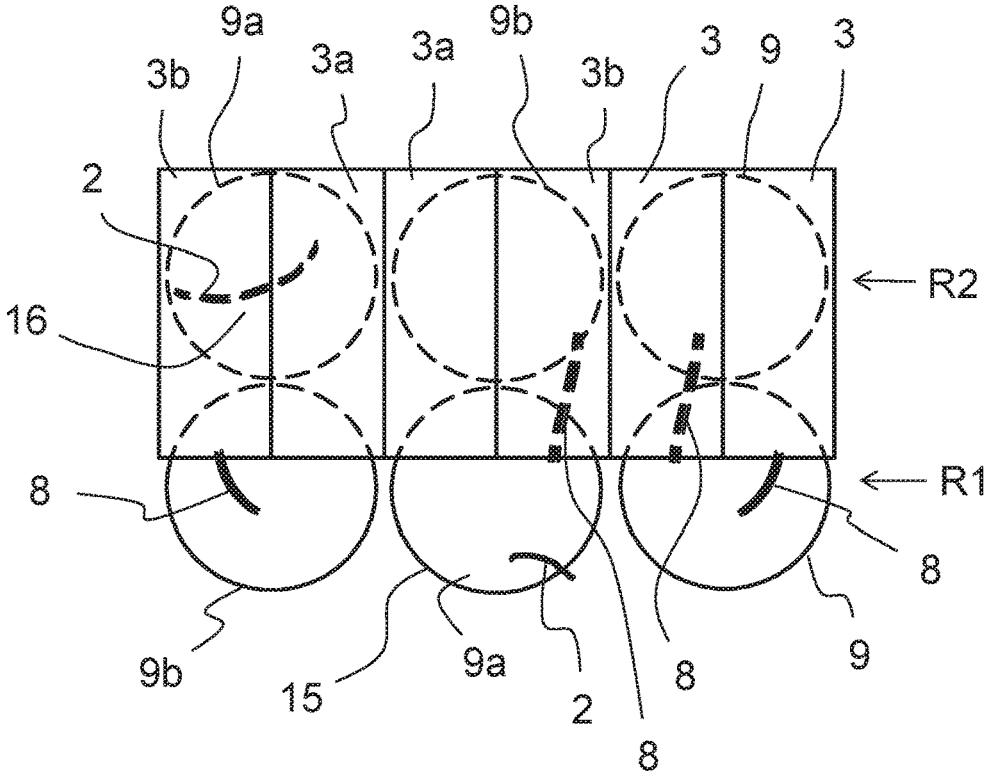
FIG. 8 shows a top view of multiple spinning positions including cans arranged in rows under the spinning positions.

FIG. 8 shows a top view of multiple spinning positions 3 including rows of cans 9 arranged underneath the spinning positions 3. The cans 9 of the first row R1 protrude from under the spinning positions 3, while the cans 9 of the second row R2 are arranged completely under the spinning positions 3. As is apparent from the sketched representation, a sliver 8 has not been placed at two spinning positions 3*a*. The corresponding cans 9*a* are located in the first row R1 as well as in the second row R2. The sliver end 2 of the can 9*a* represented in the second row R2 has been deposited in a chord-like manner over a top side 16 of the can 9. A sliver gripper 14 (not represented here) can take up the sliver end 2 with the aid of a swivel movement, which enables a movement of the sliver gripper 14 not in front of the spinning positions 3, but rather under the spinning positions 3, in contrast to the representation of the preceding figures. As soon as the sliver end 2 has been grasped on this top side 16, it is drawn through, together with the sliver gripper 14, under the spinning positions 3*a*, 3*b* and is pieced at the spinning position 3*a*.

In another alternative, the sliver end 2 has been presented hanging over the rim of the can, as represented in the can 9*a* in the first row R1. In this case, the sliver gripper 14 can grasp the sliver end 2 on the circumference 15 of the can 9*a* and feed it to the spinning position 3*a* to be supplied, as described above with respect to the other exemplary embodiments.

Of course, the sliver end 2 lying over the top side 16 can also be presented in the case of a can 9*a* of the first row R1 and the sliver end 2 hanging over the circumference 15 of the can 9*a* can also be presented in the case of a can 9*a* of the second row R2 to be supplied.

The present invention is not limited to the represented and described exemplary embodiments. Modifications within the scope of the claims are also possible, as is a combination of the features individually or in any combination, even if they are represented and described in different exemplary embodiments.

LIST OF REFERENCE NUMBERS 1 spinning machine
2 sliver end
3 spinning position
3*a* spinning position to be supplied
3*b* adjacent spinning position
4 machine frame
5 spin box
6 bobbin
7 yarn
8 sliver
9 can
9*a* can to be handled
9*b* adjacent can
10 loop-catching means
11 feed drive
12 robot
13 sliver piecing unit
14 sliver gripper
15 circumference
16 top side
S swivel movement
V displacement movement
Va displacement movement in the direction of the spinning position to be supplied
Ba area of the spinning position to be supplied
Bb area of the adjacent spinning position
R1 first row
R2 second row
RH horizontal direction
RV vertical direction
L air flow
Ls drawn-in air
Lb blown-out air
b width of the sliver gripper
M center line
K can diameter

The invention claimed is:

1. A method for feeding a sliver end of a sliver deposited in a can to a spinning position of a spinning machine, wherein the spinning machine comprises a plurality of adjacently arranged spinning positions and a plurality of cans arranged in at least a first row under the spinning positions, the method comprising:

positioning a robot at an adjacent spinning position to the spinning position to be supplied such that a sliver gripper of the robot is at the adjacent spinning position;

with the sliver gripper of the robot at the adjacent spinning position, seeking the sliver end from one of the cans;

grasping the sliver end with the sliver gripper; and feeding the sliver end to the spinning position to be supplied.

2. The method as in claim 1, comprising moving the robot along the spinning machine and positioning the robot at the spinning position to be supplied or at the adjacent spinning position.

3. The method as in claim 1, comprising moving the sliver gripper relative to the robot along the spinning machine to the area that includes the adjacent spinning position or to an area that includes a can in a second row of the cans adjacent to the first row of cans.

4. The method as in claim 3, wherein the shiver gripper is configured to grasp the sliver end from multiple possible positions at the adjacent spinning position.

5. The method as in claim 1, wherein the sliver gripper seeks the sliver end on a top side of the can or at a circumference of the can.

6. A method for feeding a sliver end of a sliver deposited in a can to a spinning position of a spinning machine, wherein the spinning machine comprises a plurality of adjacently arranged spinning positions and a plurality of cans arranged in at least a first row under the spinning positions, the method comprising:

with a sliver gripper of a robot, seeking the sliver end from one of the cans in an area that includes at least one adjacent spinning position to a spinning position to be supplied;

grasping the shiver end with the sliver gripper;

feeding the sliver end to the spinning position to be supplied; and wherein the robot is at the adjacent spinning position when the sliver end is grasped, and further comprising moving the robot with the grasped end to the spinning position to be supplied before feeding the sliver end to the spinning position to be supplied.

7. A spinning machine configured to perform the method according to claim 1.

8. The spinning machine as in claim 7, wherein the robot is movable along the spinning machine.

9. The spinning machine as in claim 8, wherein the robot is also movable along additional spinning machines.

10. The spinning machine as in claim 7, wherein the sliver gripper is movable relative to the robot along the spinning machine to the area that includes the adjacent spinning position or to an area that includes a can in a second row of the cans adjacent to the first row of cans.

11. The spinning machine as in claim 10, wherein the sliver gripper is configured to grasp the sliver end from multiple possible positions at the adjacent spinning position.

12. The spinning machine as in claim 7, wherein the sliver gripper comprises a width so as to grasp the sliver end at at least two adjacent spinning positions relative to the spinning position to be supplied.

13. The spinning machine as in claim 7, wherein the sliver gripper comprises a suction unit for drawing in the sliver end.

14. The spinning machine as in claim 7, wherein the sliver gripper comprises a blowing unit for feeding the sliver end into the spinning position to be supplied.

* * * * *